US009765787B2

(12) United States Patent
Cocks et al.

(10) Patent No.: US 9,765,787 B2
(45) Date of Patent: Sep. 19, 2017

(54) CENTRIFUGAL BLOWER HOUSING HAVING SURFACE STRUCTURES, SYSTEM, AND METHOD OF ASSEMBLY

(71) Applicant: Regal Beloit America, Inc., Beloit, WI (US)

(72) Inventors: Rachele Barbara Cocks, Columbia City, IN (US); Kerry Baker Shelton, Fort Wayne, IN (US); Joshua James Westhoff, Fort Wayne, IN (US)

(73) Assignee: Regal Beloit America, Inc., Beloit, WI (US)

( * ) Notice: Subject to any disclaimer, the term of this patent is extended or adjusted under 35 U.S.C. 154(b) by 588 days.

(21) Appl. No.: 14/280,121

(22) Filed: May 16, 2014

(65) Prior Publication Data

US 2015/0330394 A1 Nov. 19, 2015

(51) Int. Cl.

| | |
|---|---|
| ***F04D 17/10*** | (2006.01) |
| ***F04D 29/68*** | (2006.01) |
| ***F04D 29/42*** | (2006.01) |

(52) U.S. Cl.

CPC ..... *F04D 17/10* (2013.01); *F04D 29/4226* (2013.01); *F04D 29/681* (2013.01)

(58) Field of Classification Search

CPC ..... F04D 17/10; F04D 29/4226; F04D 29/681

USPC ..... 415/119, 204, 214.1, 173.1, 197, 206

See application file for complete search history.

(56) References Cited

U.S. PATENT DOCUMENTS

| | | | | |
|---|---|---|---|---|
| 3,362,469 | A * | 1/1968 | Berner | F24F 9/00 165/122 |
| 4,750,693 | A | 6/1988 | Lobert et al. | |
| 5,316,439 | A * | 5/1994 | Gatley, Jr. | F04D 29/665 415/119 |
| 5,868,551 | A * | 2/1999 | Smiley, III | F04D 29/664 415/119 |
| 5,915,922 | A | 6/1999 | Wiethe et al. | |
| 6,039,532 | A * | 3/2000 | McConnell | F04D 29/422 415/119 |
| 8,460,779 | B2 | 6/2013 | Gupta et al. | |

(Continued)

FOREIGN PATENT DOCUMENTS

| | | |
|---|---|---|
| DE | 2933358 A1 | 2/1981 |
| DE | 102006020312 A1 | 11/2007 |

(Continued)

OTHER PUBLICATIONS

Nagahashi et al, Indoor Unit of Air Conditioner, Mar. 2002, English translation of JP 2002147789.*

(Continued)

*Primary Examiner* — Hoang Nguyen

(74) *Attorney, Agent, or Firm* — Armstrong Teasdale LLP

(57) ABSTRACT

A centrifugal blower assembly includes a housing having an inner surface and an outer surface. The inner surface of the housing defines in part an interior space. The centrifugal blower also includes a first portion of texture applied to at least a first portion of at least one of the inner surface and the outer surface of the housing. The first portion of texture has a first height based at least in part on a local boundary layer height of an airflow moving across at least one of the inner surface and the outer surface respectively. The first portion of texture is configured to generate a turbulent flow within the airflow moving across the first portion of texture.

13 Claims, 7 Drawing Sheets

(56) References Cited

U.S. PATENT DOCUMENTS

| | | | | |
|---|---|---|---|---|
| 2009/0232648 | A1* | 9/2009 | Wu | F04D 29/4226 415/204 |
| 2009/0304511 | A1 | 12/2009 | Brannon, III | |
| 2015/0337862 | A1 | 11/2015 | Rao | |

FOREIGN PATENT DOCUMENTS

| | | | |
|---|---|---|---|
| JP | 2002147789 | A | 5/2002 |
| JP | 2005351205 | A | 12/2005 |
| JP | 2007138844 | | 6/2007 |

OTHER PUBLICATIONS

Furuta et al, Low Noise Device for Blower, Dec. 2005, English translation of JP 2005351205.*

European Extended Search Report, Application No. 15167726.7, dated Dec. 16, 2015, pp. 9.

* cited by examiner

CENTRIFUGAL BLOWER HOUSING HAVING SURFACE STRUCTURES, SYSTEM, AND METHOD OF ASSEMBLY

BACKGROUND

The field of the disclosure relates generally to a housing for a blower system, and more specifically, to a housing for a blower system having surface structures that enhance blower system efficiency and reduce blower system noise.

Centrifugal blower or fan systems are commonly used in the automotive, air handling, and ventilation industries for directing large volumes of forced air, over a wide range of pressures, through a variety of air conditioning components. In some known centrifugal blower systems, air is drawn into a housing through one or more inlet openings by a rotating wheel. The rotating wheel forces the air around the housing and out an outlet end. Some known centrifugal blower systems generate a high speed airflow that produces undesirable acoustic noise. Acoustic noise is generally made up from a combination of mechanical noise and aero-acoustic noise.

In general, mechanical noise is generated from the vibration of moving parts such as the blower or fan motor. Aero-acoustic noise is generated from the mixing or turbulent airflow and the airflow across the surfaces of the blower housing and ducts. Aero-acoustic noise can include whistling, tonal noise, or broadband noise generated by interactions within the airflow and noise generated as the air travels through the blower housing. This noise can be caused by the disruption of the airflow, which can interact with various system components to generate the noise. In addition, this noise may be caused by pressure changes within the airflow generated by portions of the airflow at different pressures interacting with each other or with portions of the blower housing. These pressure variances may be caused by non-uniform flow, adverse flow structures generated in the airflow, or airflow recirculation.

In some known blower systems, airflow recirculation may be caused by the mixing of the airflow entering the blower in an axial direction parallel to the rotation axis of the rotating wheel and the airflow within the blower flowing in a radial direction perpendicular to the rotation axis. The recirculating airflow generally has a swirling component that generates adverse flow structures, such as eddies or vortices, within the airflow. In addition, a laminar boundary layer of the airflow along the blower housing surfaces facilitates flow separation and can lead to the generation of these adverse flow structures or flow separation. These adverse flow structures can cause non-uniform airflow within the blower housing and at the blower outlet, which generates undesirable noise and facilitates inefficient operation of the centrifugal blower system.

The boundary layer is a very thin layer of air lying along the surfaces of the blower housing that follows the surfaces. As the air flows along the surfaces, air in the boundary layer flows smoothly over the smooth housing surfaces generating a laminar flow layer. As the air continues to flow further along the surfaces of the housing, the thickness of this laminar flow boundary layer increases due to friction with the surfaces, and in some instances, the boundary layer may also separate from the surfaces. This can result in the generation of large scale adverse flow structures, and also the airflow near the surface becoming detached, for example, curved surfaces such as the inlet ring of the blower housing. At some distance along the surface of the curved inlet ring, airflow separation may occur. This airflow separation can be reduced or eliminated with the generation of a turbulent boundary layer.

Generally, as the boundary layer height increases and interacts with the surrounding flow, it can alter the proximate full flow profile or velocity distribution of the flow. For example, in a duct, the boundary layer perturbs the flow from the walls and changes the full flow distribution and a fully developed flow profile develops. If the airflow is viscous enough or the velocity is low enough, the airflow can remain laminar. However, if the airflow is not viscous enough or the velocity is too high, the friction at the surface can actually cause some flow reversal, i.e. eddies and vortices, which start a transition to a fully turbulent flow. Placing upstream surface perturbations in the airflow can facilitate generating eddies and vortices in the airflow, which can interact with and break up the large adverse flow structures and facilitate developing a fully developed turbulent flow sooner.

BRIEF DESCRIPTION

In one aspect, a centrifugal blower assembly is provided. The centrifugal blower assembly includes a housing having an inner surface and an outer surface. The inner surface defines in part an interior space of the housing. The centrifugal blower assembly also includes a first portion of texture applied to at least a first portion of at least one of the inner surface and the outer surface of the housing. The first portion of texture has a first height based at least in part on a local boundary layer height of an airflow moving across at least one of the inner surface and the outer surface respectively. The first portion of texture is configured to generate a turbulent boundary layer within the airflow moving across the first portion of texture.

In another aspect, a method of increasing efficiency of and reducing noise generated by a centrifugal blower system is provided. The method includes providing a blower system for generating an airflow. The blower system includes a blower housing and a blower expansion coupled to the blower housing. The blower system has an inner surface and an outer surface, wherein the inner surface defines in part an interior space. The method also includes providing texturing along at least a first portion of at least one of the inner surface and the outer surface of the blower system. The texture has a first height based at least in part on a local boundary layer height of the airflow moving across at least one of the inner surface and the outer surface respectively. In addition, the method includes forcing the airflow into the interior space of the blower system, and generating a turbulent boundary layer in the airflow to enable the airflow to cling to at least one of the inner surface and the outer surface of the blower system. This increases the efficiency and reduces the noise of the centrifugal blower system.

Although specific features of various embodiments may be shown in some drawings and not in others, this is for convenience only. Any feature of any drawing may be referenced and/or claimed in combination with any feature of any other drawing.

DETAILED DESCRIPTION

Figure 1:
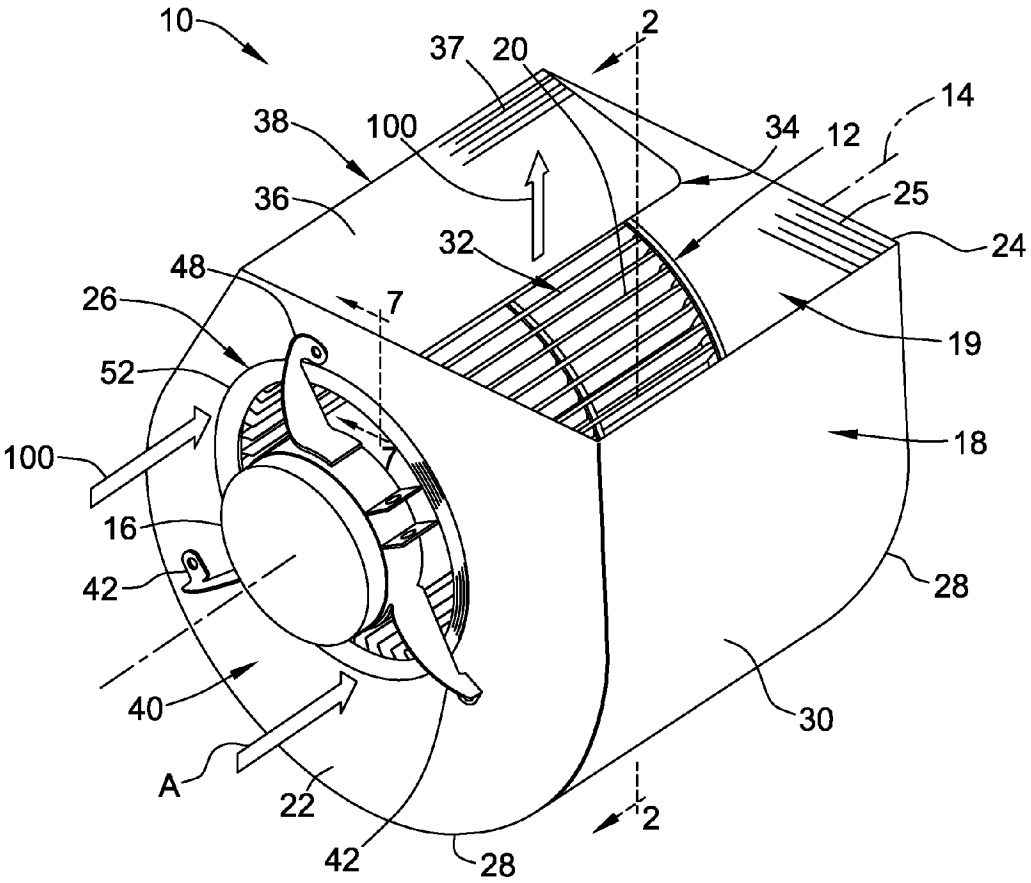
FIG. 1 is a schematic perspective of an exemplary centrifugal blower system.
Figure 2:
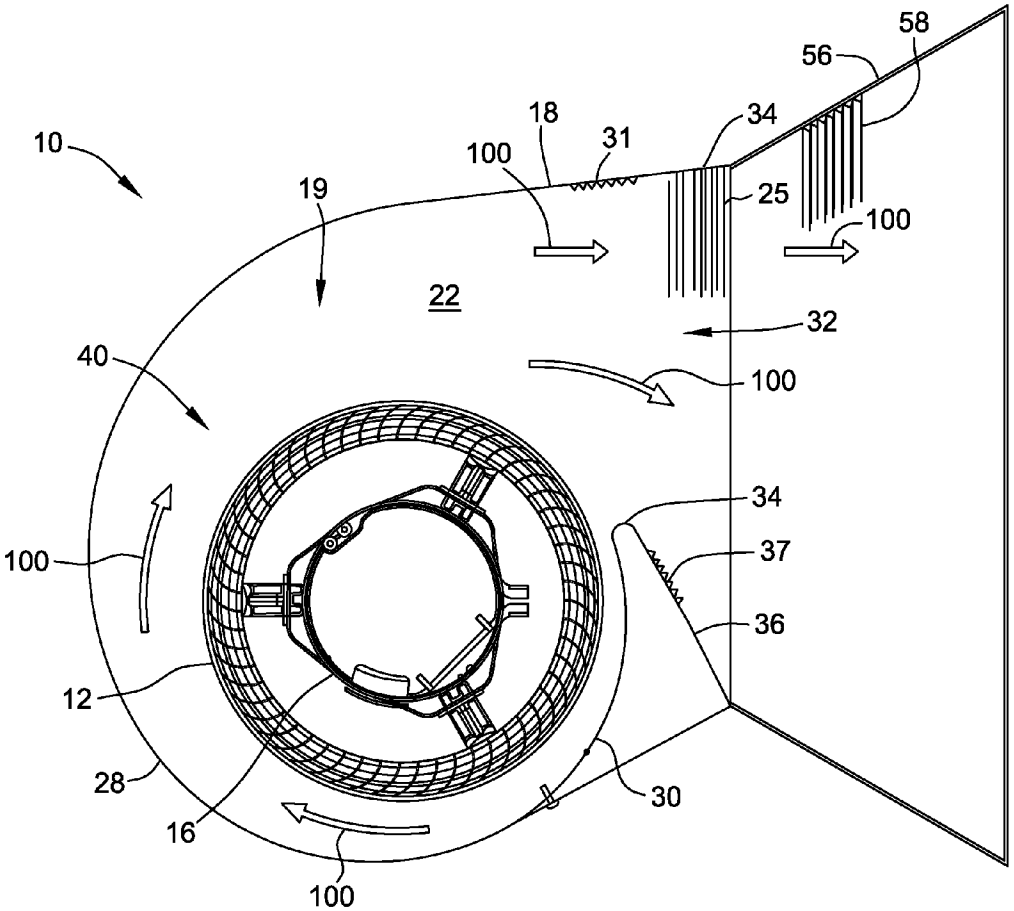
FIG. 2 is a cross-sectional view of the centrifugal blower system shown in FIG. 1 taken along line 2-2.

FIG. 1 is a schematic perspective of an exemplary centrifugal blower system 1. FIG. 2 is a cross-sectional view of centrifugal blower system 1 taken along line 2-2 of FIG. 1. As seen in FIG. 2, centrifugal blower system 1 can include a centrifugal blower 10 and a blower expansion 56, which provides a transition between centrifugal blower 10 and application ductwork (not shown). In the exemplary embodiment, the centrifugal blower 10 includes a fan impeller 12 having an axis of rotation 14. Fan impeller 12 is coupled to a motor 16, which is configured to rotate fan impeller 12 about axis of rotation 14. The rotation of fan impeller 12 draws air into centrifugal blower 10 along axis of rotation 14 as represented by airflow arrows 100, and expels the air radially outward into a housing 18. In the exemplary embodiment, fan impeller 12 is formed from a plurality of forward curved fan blades 20. Alternatively, fan blades 20 may include backward curved blades, airfoil blades, backward inclined blades, radial blades, or any other suitable blade shape that enables fan impeller 12 to operate as described herein. In the exemplary embodiment, the shape of fan blades 20 of fan impeller 12 facilitates reducing operating noise of fan impeller 12. Fan impeller 12 is configured to produce a flow of air for a forced air system, e.g., without limitation, a residential HVAC system.

In the exemplary embodiment, housing 18 includes a first sidewall 22 and an opposite second sidewall 24, each sidewall having an inner textured surface 25. It is contemplated that only a portion of sidewalls 22 and 24 may have inner textured surface 25, or that inner textured surface 25 may be omitted from sidewall 22 and 24. In the exemplary embodiment, sidewalls 22 and 24 are fabricated as generally flat, parallel sidewalls disposed at axially opposite ends of fan impeller 12. An outer periphery 28 of each of sidewalls 22 and 24 is shaped substantially the same and generally forms a volute shape with respect to axis of rotation 14.

In the exemplary embodiment, a volute outer wall 30, having an inner textured surface 31, is coupled between sidewalls 22 and 24. More specifically, volute outer wall 30 is coupled to outer periphery 28 of sidewalls 22 and 24 thereby forming an increasing expansion angle for airflow 100 through housing 18. It is contemplated that only a portion of volute outer wall 30 may have inner textured surface 31, or that inner textured surface 31 may be omitted from volute outer wall 30. In the exemplary embodiment, volute outer wall 30, which extends around fan impeller 12, includes a cutoff portion 34 including a cutoff wall 36 that is at least partially disposed within an interior space 19 of housing 18. In the exemplary embodiment, cutoff wall 36 includes a textured surface 37. Alternatively, only a portion of cutoff wall 36 may have inner textured surface 37, or inner textured surface 37 may be omitted entirely from cutoff wall 36.

In the exemplary embodiment, housing 18 includes an air inlet opening 26 provided in first sidewall 22. Further, an air outlet opening 32 is defined, at least in part, by cutoff portion 34, sidewalls 22 and 24, and volute outer wall 30. In the exemplary embodiment, airflow 100 is expelled from centrifugal blower 10 through air outlet opening 32. Proximate air outlet opening 32, housing 18 includes an expansion portion 38, generally defined by the portion of housing 18 extending from air outlet opening 32 away from fan impeller 12. Housing 18 also includes a housing portion 40, generally defined as the volute-shaped portion surrounding fan impeller 12. In the exemplary embodiment, each of the components of housing 18 may be fabricated from any material that enables housing 18 to function as described herein, for example, without limitation, aluminum, steel, thermoplastics, fiber reinforced composite materials, or any combination thereof.

Further, in the exemplary embodiment, motor 16 of centrifugal blower 10 is disposed in air inlet opening 26 and is coupled to housing 18 by a plurality of mounting arms 42. Alternatively, second sidewall 24 may include an opening (not shown) to accommodate motor 16.

As seen in FIG. 2, centrifugal blower 10 may be connected to blower expansion 56. In the exemplary embodiment, blower expansion 56 includes an inner textured surface 58. It is contemplated that only a portion of blower expansion 56 may have inner textured surface 58, or that inner textured surface 58 may be omitted from blower expansion 56. In the exemplary embodiment, blower expansion 56 is fabricated from generally flat panels coupled to the periphery of expansion portion 38 of housing 18. In the exemplary embodiment, blower expansion 56 may be fabricated from any material that enables blower expansion 56 to function as described herein, for example, without limitation, aluminum, steel, thermoplastics, fiber reinforced composite materials, or any combination thereof.

In operation, fan impeller 12 rotates about axis of rotation 14 to draw air into housing 18 through air inlet opening 26. The amount of air moved by centrifugal blower system 1 increases as a point on fan impeller 12 moves within housing 18 from cutoff portion 34 towards air outlet opening 32. Volute outer wall 30 is positioned progressively further away from fan impeller 12 in the direction of rotation of fan impeller 12 to accommodate the increasing volume of air due to the volute shape of housing 18. Fan impeller 12 generates high velocity airflow 100 that is exhausted from air outlet opening 32. Fan impeller 12 draws airflow 100 into centrifugal blower 10 through air inlet opening 26 in the axial direction (referring to axis of rotation 14) and turns airflow 100 to a generally radial direction (referring to a radial direction generally perpendicular to axis of rotation 14). The rapid change in direction of airflow 100 causes differences in the airflow velocity and pressure between the portion of airflow 100 flowing through air inlet opening 26 and the portion within housing 18. These pressure and velocity differences cause a portion of airflow 100 to recirculate behind fan impeller 12 and form adverse flow structures. Recirculation is caused by a high pressure portion of airflow 100 flowing behind fan impeller 12 to a low pressure portion of airflow 100 in housing 18. These differing pressures create downstream disturbances such as buffeting that cause centrifugal blower 10 to operate inefficiently and produce undesired noise.

Airflow 100 passes through air outlet opening 32 having a circumferential (tangent to a circle swept by fan impeller 12) path that causes separation of airflow 100 from volute outer wall 30 proximate expansion portion 38 of housing 18. Such separation of airflow 100 can form eddies adjacent volute outer wall 30. Similarly, eddies formed in airflow 100 adjacent volute outer wall 30 also cause turbulence and adverse flow structures in airflow 100. The turbulence created by eddies in airflow 100 may cause centrifugal blower 10 to operate inefficiently and produce undesired noise downstream of centrifugal blower 10. Improved airflow distribution within housing 18 and at air outlet opening 32 facilitates preventing recirculation of air within housing 18 and the formation of eddies downstream of air outlet opening 32. Eliminating airflow recirculation and improving airflow 100 distribution at air outlet opening 32 facilitates improved blower operating efficiency and a reduction in undesirable noise.

In the exemplary embodiment, textured surfaces 25 of sidewalls 22 and 24, textured surface 31 of volute outer wall 30, and textured surface 37 of cutoff wall 36 are configured to generate a turbulent boundary layer passing over textured surfaces 25, 31, and 37. Generation of a turbulent boundary layer facilitates reducing adverse flow structures, improving efficiency, and reducing blower noise. As used herein "adverse flow structures" is used to designate flow structures, such as recirculation, vortices, turbulence, and eddies, in airflow 100 that have negative effects on centrifugal blower system 1 operation. A "boundary layer" is the zone of reduced velocity air that is immediately adjacent to the surfaces of centrifugal blower system 1, for example, without limitation, sidewalls 22 and 24, volute outer wall 30, and cutoff wall 36. The thickness or height of the boundary layer is typically defined as the distance from the surface at which the airflow velocity is 99% of the "freestream" velocity where the air is unaffected by the viscous or friction forces of the surface. A local boundary layer height is the determined boundary layer height relative to a particular position. "Flow separation" occurs when the boundary layer travels far enough against an adverse pressure gradient that the airflow velocity falls almost to zero. The airflow then becomes detached from flowing over the surface and instead forms eddies and vortices, resulting in "turbulent flow." The term "turbulent flow" and "turbulence" means the airflow in which local velocities and pressure fluctuate irregularly, in a random manner, causing vortices and eddies in the airflow.

Figure 3:
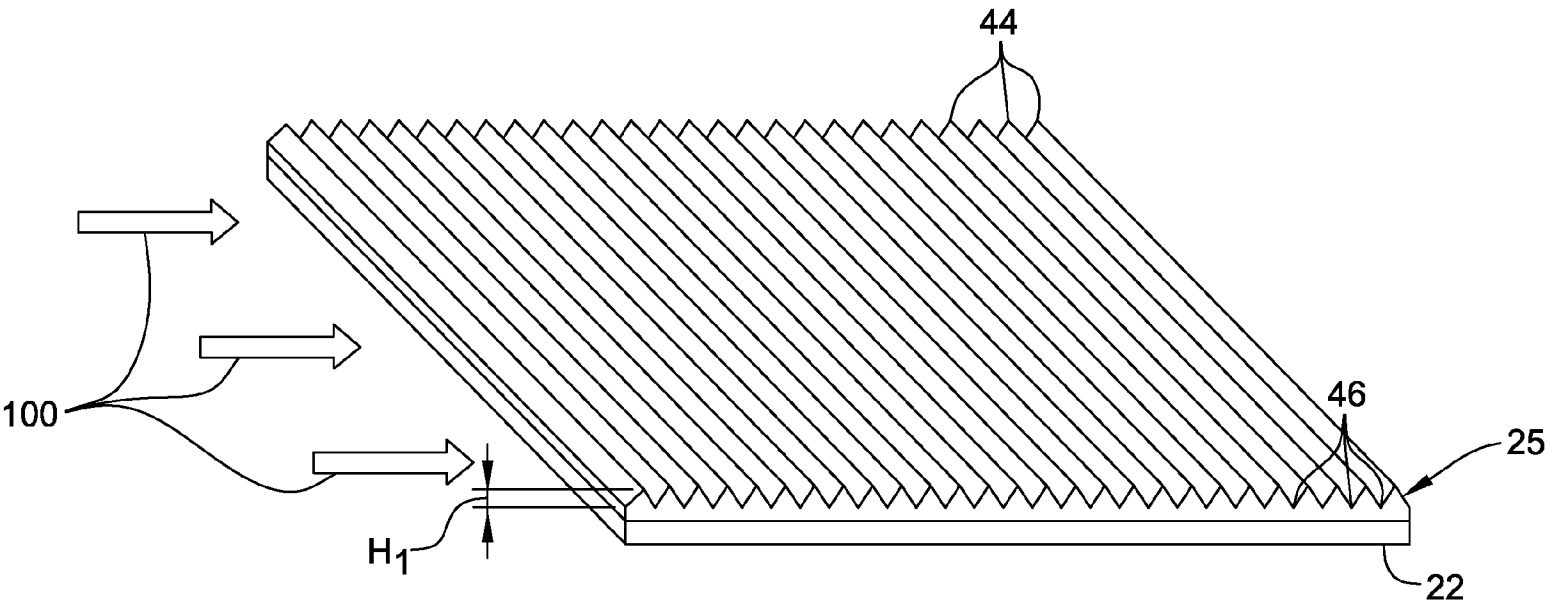
FIG. 3 is a fragmentary perspective view of a textured surface for use with the centrifugal blower system shown in FIG. 1.

FIG. 3 is a fragmentary perspective view of textured surface 25 for use with centrifugal blower system 1 shown in FIG. 1. In the exemplary embodiment, as seen in FIG. 3, the texturing includes a plurality of longitudinal parallel ridges 44 and furrows 46 extending over textured surface 25 of sidewall 22 in a direction substantially perpendicular to the airflow 100. In the exemplary embodiment, ridges 44 and furrows 46 are shown having a pyramid profile shape with sharp transitions. Alternatively, ridges 44 and furrows 46 can have generally smooth or curved transitions or can have any desirable profile shape, for example, without limitation, curved, rectangular, polygonal, and the like, and combinations thereof. For example, without limitation, in one suitable embodiment, ridges 44 and furrows 46 can include a plurality of staggered, polygonal shapes in cross-section. In the exemplary embodiment, the texturing shown in FIG. 3 also extends along textured surfaces 25, 31, 37, and 58, of sidewall 24, volute outer wall 30, cutoff wall 36, and blower expansion 56 respectively, in a direction substantially perpendicular to airflow 100. Alternatively, longitudinal parallel ridges 44 and furrows 46 may extend along inner surfaces 25, 31, 37, and 58 at any angle greater than zero with respect to airflow 100 that enables housing 18 and blower expansion 56 to function as described herein.

In the exemplary embodiment, ridges 44 and furrows 46 are formed as a separate sheet material that is coupled to sidewalls 22 and 24, volute outer wall 30, cutoff wall 36, and blower expansion 56, for example, without limitation, by adhesive bonding. The textured sheet material may be fabricated from materials such as, for example, without limitation, aluminum, steel, thermoplastics, fiber reinforced composite materials, or any combination thereof. Alternatively, sidewalls 22 and 24, volute outer wall 30, cutoff wall 36, and blower expansion 56 may be formed with integral ridges 44 and furrows 46, such as, for example, formed from a corrugated sheet material.

Ridges 44 have a height H1 measured from furrow 46 that is determined based on varying local boundary layer characteristics. In the exemplary embodiment, height H1 of ridges 44 ranges between about 1% of the local boundary layer height to multiple times the local boundary layer height, for example, without limitation, 5 to 10 times the local boundary layer height. One advantage of the present disclosure is the customization to the varying local boundary layer with tailored and varying heights H1 of ridges 44 along the airflow 100 direction. Another advantage is that textured surfaces 25, 31, 37, and 58 can be applied either continuously or discontinuously along sidewalls 22 and 24, volute outer wall 30, cutoff wall 36, and blower expansion 56 respectively. For example, without limitation, in one suitable embodiment, textured surface 31 of volute outer wall 30 may have an increasing height H1 as it extends from cutoff portion 34 along volute outer wall 30 to air outlet opening 32, such that a first portion of texture has a different height of a second portion of texture. Alternatively or in addition, textured surface 31 may be applied discontinuously along volute outer wall 30 based on varying airflow 100 characteristics at different locations along volute outer wall 30. In another suitable embodiment, for example, a first portion of textured surfaces 25 of sidewalls 22 and 24, textured surface 31 of volute outer wall 30, and textured surface 37 of cutoff wall 36 may only be applied to expansion portion 38 of housing 18, or alternatively, only to housing portion 40. Thus, differing portions of textured surfaces 25, 31, 37, and 58 can be customized and particularly placed based on specific airflow 100 characteristics at specific locations within housing 18 and blower expansion 56.

In the exemplary embodiment, ridges 44 and furrows 46 facilitate increasing the rigidity of sidewalls 22 and 24, volute outer wall 30, cutoff wall 36, and blower expansion 56. An increase in rigidity can facilitate decreasing the mechanical noise generated by motor 16 of centrifugal blower 10. The vibration energy which is converted to acoustic energy of sidewalls 22 and 24, volute outer wall 30, cutoff wall 36, and blower expansion 56 is absorbed by structural damping due to increased rigidity. By increasing structural damping of sidewalls 22 and 24, volute outer wall 30, cutoff wall 36, and blower expansion 56, mechanical noise can be reduced.

Figure 4:
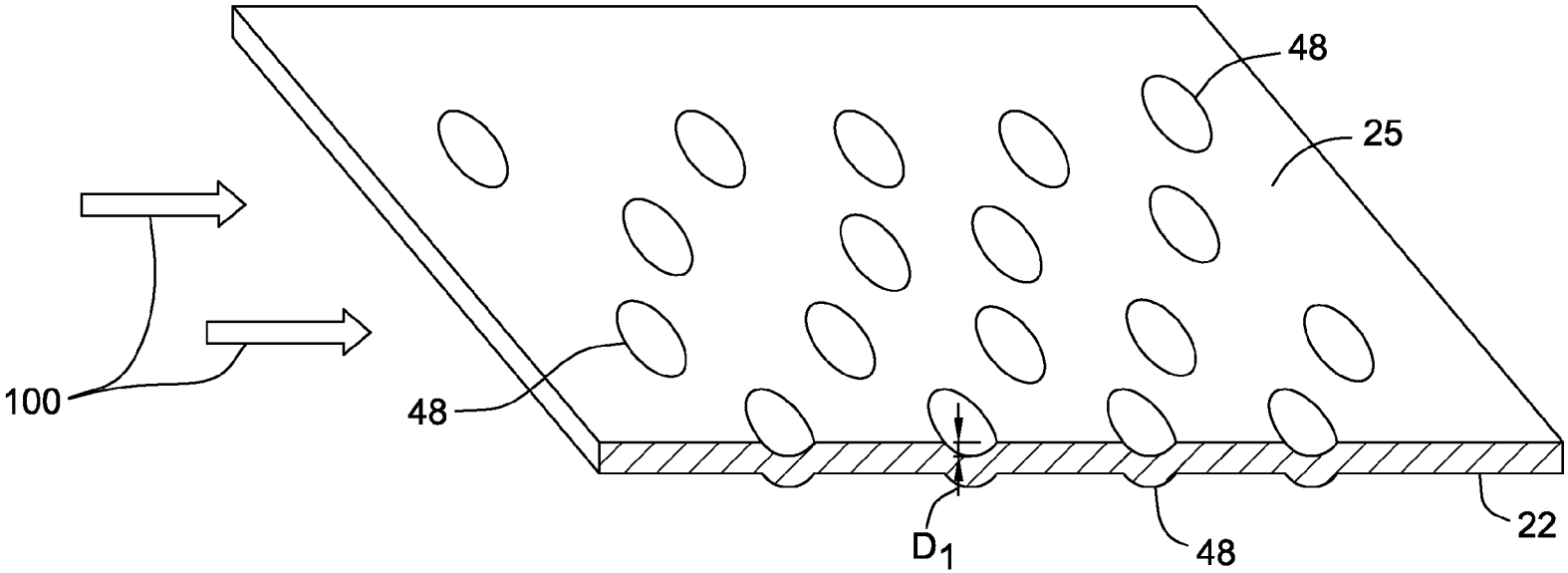
FIG. 4 is a fragmentary perspective view of an alternative textured surface for use with the centrifugal blower system shown in FIG. 1.
Figure 5:
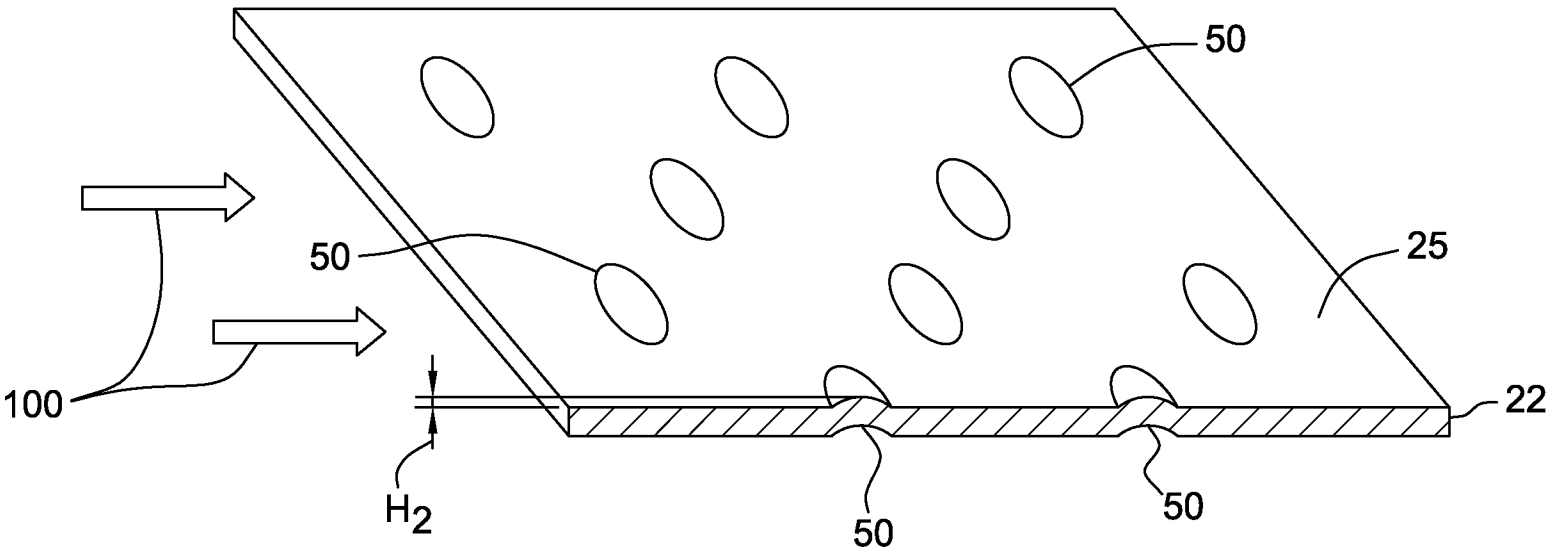
FIG. 5 is a fragmentary perspective view of yet another alternative textured surface for use with the centrifugal blower system shown in FIG. 1.

In an alternative embodiment, the texturing of textured surfaces 25, 31, 37, and 58 includes a plurality of dimples distributed over sidewalls 22 and 24, volute outer wall 30, cutoff wall 36, and blower expansion 56 respectively. FIG. 4 is a fragmentary perspective view of an alternative textured surface 25 for use with centrifugal blower system 1 shown in FIG. 1. The texturing includes a plurality of dimples 48 distributed over textured surface 25 of sidewall 22. In this embodiment, dimples 48 are circular. Alternatively, dimples 48 may be any other shape, for example, without limitation, ellipses or polygons, that enables housing 18 to function as described herein. In yet another alternate embodiment, shown in FIG. 5, the texturing includes a plurality of bumps 50 that extend from textured surfaces 25, 31, 37, and 58. In this embodiment, bumps 50 are circular. Alternatively, bumps 50 may be any other shape, for example, without limitation, ellipses or polygons, that enables housing 18 to function as described herein. As with ridges 44 described above, dimples 48 have a depth D1 and bumps 50 have a height H2 that is determined based on varying local boundary layer characteristics. Depth D1 and height H2 ranges between about 1% of the local boundary layer height to multiple times the local boundary layer height, for example, without limitation, 5 to 10 times the local boundary layer height. Dimples 48 or bumps 50 can be applied either continuously or discontinuously along sidewalls 22 and 24, volute outer wall 30, cutoff wall 36, and blower expansion 56, and can vary in both size and shape. Thus, dimples 48 or bumps 50 can be customized and particularly placed based on specific airflow 100 characteristics at specific locations within housing 18 and blower expansion 56.

Dimples 48 or bumps 50 facilitate increasing the rigidity of sidewalls 22 and 24, volute outer wall 30, cutoff wall 36, and blower expansion 56. An increase in rigidity can facilitate decreasing the mechanical noise generated by motor 16 of centrifugal blower 10. As described above, the vibration energy of sidewalls 22 and 24, volute outer wall 30, cutoff wall 36, and blower expansion 56 is absorbed by structural damping due to increased rigidity. By increasing structural damping of sidewalls 22 and 24, volute outer wall 30, cutoff wall 36, and blower expansion 56, mechanical noise can be reduced.

Figure 6:
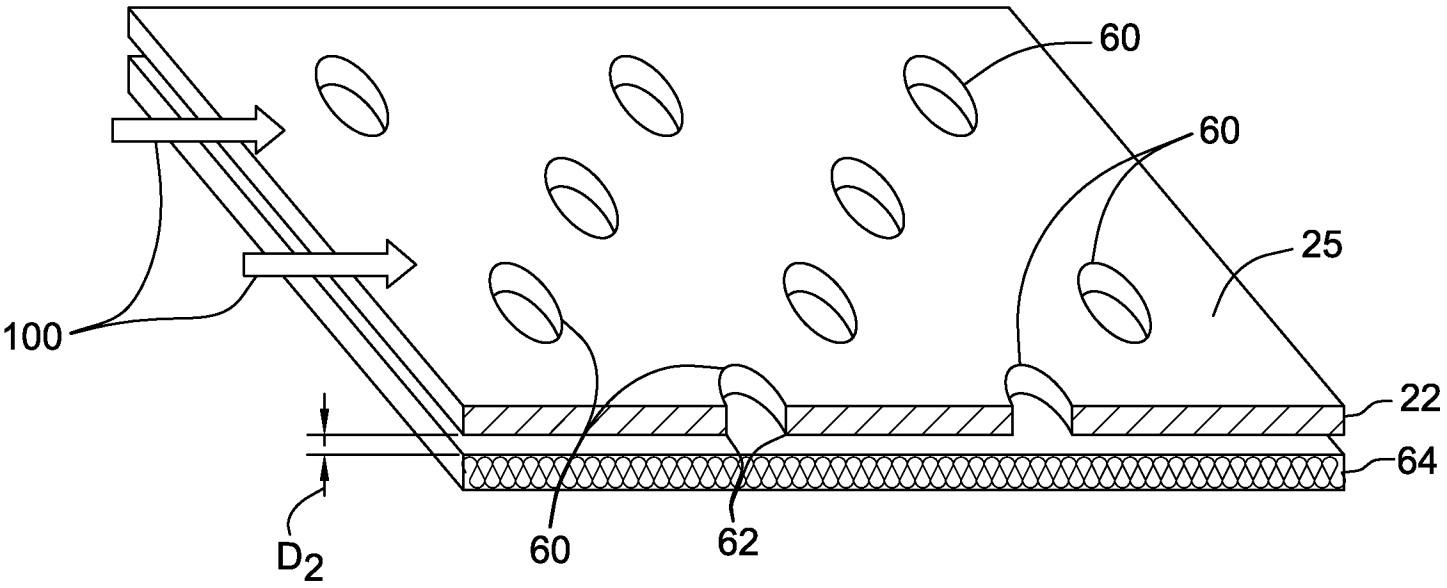
FIG. 6 is a fragmentary perspective view of an alternative textured surface for use with the centrifugal blower system shown in FIG. 1.

In another alternative embodiment, the texturing of textured surfaces 25, 31, 37, and 58 includes a plurality of perforations distributed over sidewalls 22 and 24, volute outer wall 30, cutoff wall 36, and blower expansion 56 respectively. FIG. 6 is a fragmentary perspective view of an alternative textured surface 25 for use with centrifugal blower system 1 shown in FIG. 1. The texturing includes a plurality of perforations 60 distributed over textured surface 25 of sidewall 22. In this embodiment, perforations 60 are circular. Alternatively, perforations 60 may be any other shape, for example, without limitation, ellipses or polygons, that enables housing 18 to function as described herein. In the exemplary embodiment, perforations 60 may be formed such that they have a dimpled edge 62 that extends away from textured surface 25 a depth D2 to facilitate increasing the rigidity of sidewalls 22 and 24, volute outer wall 30, cutoff wall 36, and blower expansion 56. As with ridges 44 described above, depth D1 is determined based on varying local boundary layer characteristics and can extend either upward or downward from sidewalls 22 and 24, volute outer wall 30, cutoff wall 36, and blower expansion 56. Depth D2 ranges between about 1% of the local boundary layer height to multiple times the local boundary layer height, for example, without limitation, 5 to 10 times the local boundary layer height. Perforations 60 can be applied either continuously or discontinuously along sidewalls 22 and 24, volute outer wall 30, cutoff wall 36, and blower expansion 56, and can vary in both size and shape. Thus, perforations 60 can be customized and particularly placed based on specific airflow 100 characteristics at specific locations within housing 18 and blower expansion 56.

Perforations 60 facilitate increasing the rigidity of sidewalls 22 and 24, volute outer wall 30, cutoff wall 36, and blower expansion 56. An increase in rigidity can facilitate decreasing the mechanical noise generated by motor 16 of centrifugal blower 10. As described above, the vibration energy of sidewalls 22 and 24, volute outer wall 30, cutoff wall 36, and blower expansion 56 is absorbed by structural damping due to increased rigidity. By increasing structural damping of sidewalls 22 and 24, volute outer wall 30, cutoff wall 36, and blower expansion 56, mechanical noise can be reduced. Furthermore, as seen in FIG. 6, sidewalls 22 and 24, volute outer wall 30, cutoff wall 36, and blower expansion 56 having perforations 60 can include a sound insulating material 64 positioned on a side opposite airflow 100. Sidewalls 22 and 24, volute outer wall 30, cutoff wall 36, and blower expansion 56 having perforations 60, when used in association with sound insulating material 64 can effectively reduce the level of aero-acoustic noise emitted by centrifugal blower system 1. One suitable type of sound insulating material can include, for example, without limitation, fiberglass batt insulation.

Figure 7:
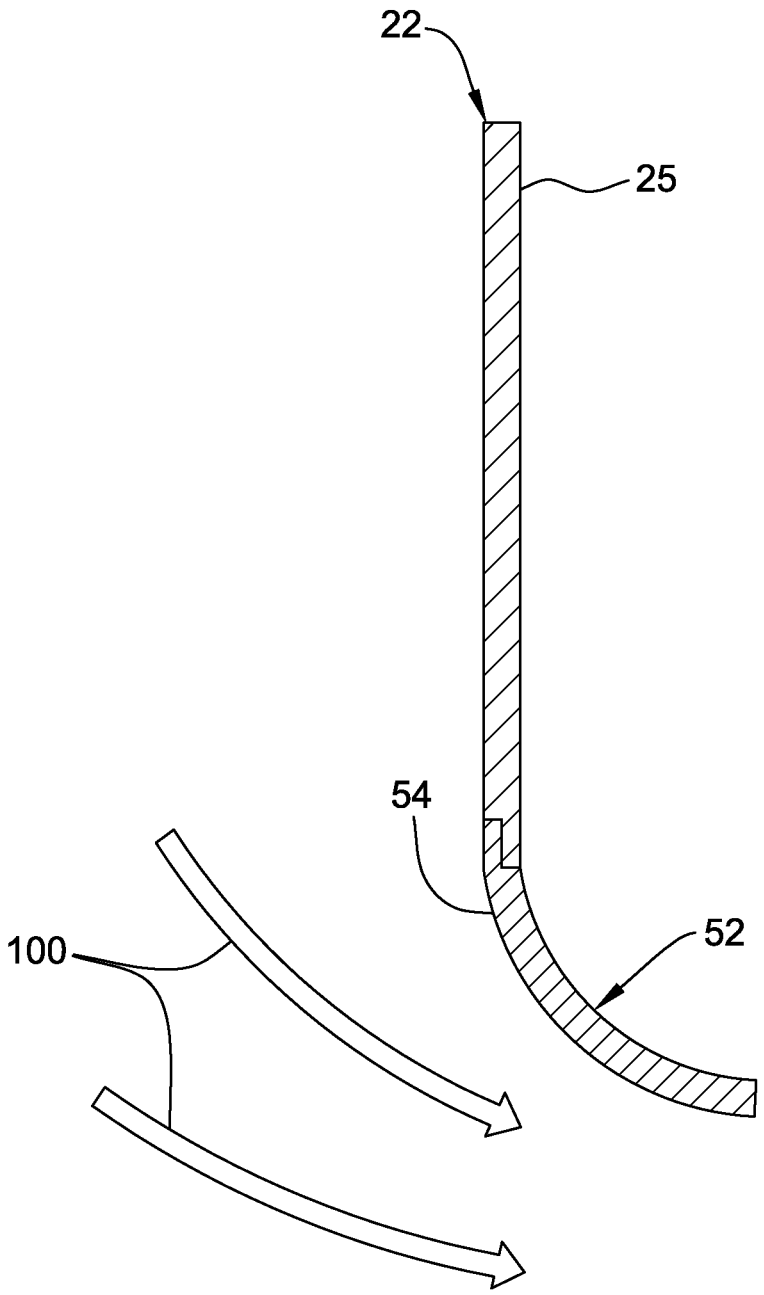
FIG. 7 is a cross-sectional view of a portion of the centrifugal blower system shown in FIG. 1, taken along line 7-7.

FIG. 7 is a cross-sectional view of a portion of centrifugal blower system 1 of FIG. 1 taken along line 7-7. With reference to FIGS. 1 and 7, sidewall 22 includes air inlet opening 26. In the exemplary embodiment, air inlet opening 26 includes an inlet ring 52 having an outer textured surface 54. Inlet ring 52 is formed as a smooth transition from the substantially planar sidewall 22 to an axial direction of fan impeller 12, i.e., substantially perpendicular to sidewall 22, having a substantially curved cross-sectional shape. In the exemplary embodiment, as airflow 100 is drawn into air inlet opening 26 by fan impeller 12, airflow 100 accelerates over surface 54. As airflow 100 accelerates, it can separate from surface 54 as it enters housing 18, forming eddies and vortices in the airflow, resulting in adverse flow structures. Separation of airflow 100 causes highly-disturbed inlet airflow and reduces the cross-sectional area of air inlet opening 26 seen by airflow 100, thereby decreasing the efficiency of centrifugal lower 10.

In the exemplary embodiment, textured surface 54 is configured to generate a turbulent flow passing over textured surface 54. As described above with respect to textured surfaces 25, 31, 37, and 58, and as seen in FIGS. 3-6, textured surface 54 can include at least one of ridges 44 and furrows 46, dimples 48, bumps 50, and perforations 60. Alternatively, textured surface 54 can include any type of boundary layer trip device that enables inlet ring 52 to function as described herein, for example, without limitation, a turbulator tape including a zig-zag pattern having angles that range between about 30 degrees and about 75 degrees.

In operation, fan impeller 12 rotates about axis of rotation 14 and draws airflow 100 into centrifugal blower 10 through air inlet opening 26 in the axial direction (referring to axis of rotation 14). Airflow 100 is drawn in and accelerated around textured surface 54 where the rapid change in direction causes airflow 100 to separate at some distance along the surface of curved inlet ring 52. Such separation of airflow 100 causes the formation of eddies and vortices adjacent a downstream portion of inlet ring 52. These eddies and vortices cause turbulence and adverse flow structures in airflow 100 and also cause a virtual decreased cross-sectional area of air inlet opening 26 as seen by airflow 100, which causes more restriction to airflow 100 at air inlet opening 26. The turbulence created by eddies and vortices in airflow 100 cause centrifugal blower system 1 to operate inefficiently. Textured surface 54 induces an earlier transition to turbulent flow that delays the onset of airflow 100 separation. The turbulent flow clings to textured surface 54, enabling airflow 100 to flow along surface 54 further before separation occurs. In some instances, separation may be eliminated. By delaying the onset of airflow 100 separation, the size of the eddies and vortices that cause turbulence and adverse flow structures in airflow 100 are reduced. This reduction facilitates increasing the efficiency of centrifugal blower system 1 by reducing adverse flow structures and increasing the cross-sectional area seen by airflow 100 at air inlet opening 26.

An exemplary method of assembling a centrifugal blower system 1 shown in FIG. 1 is provided herein. The method includes providing centrifugal blower system 1 (Shown in FIG. 1) for generating airflow 100 (Shown in FIG. 1), for e.g., an HVAC system (not shown). Centrifugal blower system 1 includes centrifugal blower 10, which includes housing 18 having a plurality of walls, for example, without limitation, sidewall 22 and 24, volute outer wall 30, cutoff wall 36, and blower expansion 56, and at least one air inlet ring 52. The method also includes providing texturing along at least a portion of the plurality of walls 22, 24, 30, 36, and 58, and inlet ring 52, wherein the texturing is configured to generate a turbulent flow in airflow 100. Generating a turbulent flow in airflow 100 promotes prolonged attachment of airflow 100 along the plurality of walls 22, 24, 30, 36, and 58, and inlet ring 52, which facilitates reducing adverse flow structures in airflow 100, increasing the efficiency of centrifugal blower system 1, and reducing blower noise. The method further includes forcing airflow 100 into housing 18 of centrifugal blower 10. In addition, the method includes generating a turbulent flow in airflow 100 to increase efficiency and reduce noise of centrifugal blower system 1.

The apparatus, methods, and systems described herein provide a centrifugal blower having increased efficiency, reduced noise, and an improved airflow distribution at the blower outlet opening. One advantage to the texturing of the housing walls of the centrifugal blower described includes customization of the texture to the varying local boundary layer with tailored and varying heights of the texture along the direction of airflow. Another advantage is that the surface texture can be customized and positioned on the centrifugal blower to advantageously generate turbulent flow in the main flow volume of the centrifugal blower. Yet another advantage is that the texture can be applied either continuously or discontinuously along the blower housing walls at address particular areas of concern along the flow path of the airflow. The exemplary embodiments described herein provide apparatus, systems, and methods particularly well-suited for HVAC centrifugal blowers.

Exemplary embodiments of the centrifugal blower are described above in detail. The centrifugal blower and its components are not limited to the specific embodiments described herein, but rather, components of the systems may be utilized independently and separately from other components described herein. For example, the components may also be used in combination with other machine systems, methods, and apparatuses, and are not limited to practice with only the systems and apparatus as described herein. Rather, the exemplary embodiments can be implemented and utilized in connection with many other applications.

Although specific features of various embodiments of the disclosure may be shown in some drawings and not in others, this is for convenience only. In accordance with the principles of the disclosure, any feature of a drawing may be referenced and/or claimed in combination with any feature of any other drawing.

This written description uses examples to disclose the invention, including the best mode, and to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

What is claimed is:

1. A method of increasing efficiency of and reducing noise generated by a centrifugal blower system, said method comprising:

providing a blower system for generating an airflow, the blower system having a blower housing and a blower expansion coupled to the blower housing, the blower system having an inner surface and an outer surface, the inner surface defining in part an interior space;

determining a local boundary layer height of the airflow moving across the inner surface;

providing texture along at least a first portion of at least one of the inner surface and the outer surface of the blower system; and determining a first height of the texture based on the determined local boundary layer height, wherein the texture first height generates a turbulent boundary layer in the airflow and enables the airflow to cling to the inner surface of the blower system, thereby increasing the efficiency, and reducing the noise of the centrifugal blower system assembly.

2. The method in accordance with claim 1, wherein providing texture along at least a first portion of at least one of the inner surface and the outer surface of the blower system comprises providing a plurality of longitudinal parallel ridges and furrows extending over at least one of said inner surface and said outer surface extending is a direction substantially perpendicular to a direction of the airflow.

3. The method in accordance with claim 1, wherein providing texture along at least a first portion of at least of one of the inner surface and the outer surface of the blower system comprises providing texture along at least the first portion of at least of one of the inner surface and the outer surface of the blower system and along at least a second portion of at least of one of the inner surface and the outer surface of the blower system, wherein the second portion is different from the first portion.

4. The method in accordance with claim 1, wherein providing texture along at least a first portion of at least of one of the inner surface and the outer surface of the blower system comprises providing texture along the entire inner surface of the blower system.

5. The method in accordance with claim 1, wherein providing a blower system for generating an airflow comprises providing a blower system having an inlet ring including an inner surface and an outer surface.

6. The method in accordance with claim 5, wherein providing texture along at least a first portion of at least of one of the inner surface and the outer surface of the blower system comprises providing texture only along the outer surface of the inlet ring.

7. The method in accordance with claim 2, wherein providing a plurality of longitudinal parallel ridges and furrows comprises providing a plurality of longitudinal parallel ridges and furrows defining a profile shape including one or more of the following: pyramidal having sharp transitions, pyramidal having curved transitions, curved, and polygonal.

8. The method in accordance with claim 1, wherein providing a blower system for generating an airflow comprises providing the blower system, wherein the blower housing includes at least one of a sidewall, a volute outer wall, and a cutoff wall defining in part the inner surface, at least one of the sidewall, the volute outer wall, and the cutoff wall including a plurality of perforations therethrough.

9. The method in accordance with claim 1 further comprising:

providing a second portion of texture along at least a second portion of at least one of the inner surface and the outer surface of the blower system; and determining a second height of the second portion of texture based on the determined local boundary layer height, wherein the texture second height is different than the first height.

10. The method in accordance with claim 1, wherein providing texture along at least a first portion of at least of one of the inner surface and the outer surface of the blower system comprises providing a plurality of dimples formed in at least one of the inner surface and the outer surface, wherein the plurality of dimples are configured to increase the rigidity of the inner surface and outer surface.

11. The method in accordance with claim 10, wherein providing a plurality of dimples comprises providing the plurality of dimples formed in one or more of the following shapes: circular, elliptical, and polygonal.

12. The method in accordance with claim 1, wherein providing texture along at least a first portion of at least of one of the inner surface and the outer surface of the blower system comprises providing a plurality of bumps that extend from at least one of the inner surface and the outer surface, wherein the plurality of bumps are configured to increase the rigidity of the inner and outer surface.

13. The method in accordance with claim 12, wherein providing a plurality of bumps comprises providing the plurality of bumps formed in one or more of the following shapes: circular, elliptical, and polygonal.

* * * * *